US010294575B2

(12) United States Patent
Iwatsu

(10) Patent No.: US 10,294,575 B2
(45) Date of Patent: May 21, 2019

(54) ELECTRIC FIELD TREATMENT METHOD AND ELECTRIC FIELD TREATMENT DEVICE

(71) Applicant: TOKYO ELECTRON LIMITED, Tokyo (JP)

(72) Inventor: Haruo Iwatsu, Kumamoto (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 355 days.

(21) Appl. No.: 15/110,231

(22) PCT Filed: Dec. 12, 2014

(86) PCT No.: PCT/JP2014/082969
§ 371 (c)(1),
(2) Date: Jul. 7, 2016

(87) PCT Pub. No.: WO2015/104951
PCT Pub. Date: Jul. 16, 2015

(65) Prior Publication Data

US 2016/0326663 A1 Nov. 10, 2016

(30) Foreign Application Priority Data

Jan. 8, 2014 (JP) ..... 2014-001466

(51) Int. Cl.
*C25D 5/00* (2006.01)
*C25D 17/10* (2006.01)
(Continued)

(52) U.S. Cl.
CPC ..... *C25D 5/00* (2013.01); *C25D 17/005* (2013.01); *C25D 17/007* (2013.01); *C25D 17/10* (2013.01); *C25D 21/12* (2013.01); *C25F 7/00* (2013.01)

(58) Field of Classification Search
CPC ..... C25D 7/00
See application file for complete search history.

(56) References Cited

U.S. PATENT DOCUMENTS 4,120,759 A * 10/1978 Asami ..... C25D 21/12 204/DIG. 7
2003/0070941 A1* 4/2003 Hirao ..... C25D 21/12 205/775
2016/0083856 A1* 3/2016 Iwatsu ..... C25D 17/10 205/477

FOREIGN PATENT DOCUMENTS

JP 2006-348356 A 12/2006
JP 2012-132058 A 7/2012
JP 2013-19057 A 1/2013

OTHER PUBLICATIONS

International Search Report dated Mar. 3, 2015 in PCT/JP2014/082969.

* cited by examiner

*Primary Examiner* — Bryan D. Ripa
(74) *Attorney, Agent, or Firm* — Rothwell, Figg, Ernst & Manbeck, P.C.

(57) ABSTRACT

An electrolytic treatment device that performs a prescribed treatment using ions to be treated that are contained in a treatment liquid, and includes a direct electrode and a counter electrode which are arranged on either side of the treatment liquid, an indirect electrode which forms an electric field in the treatment liquid, and a switch which switches between connection of the indirect electrode to the power source and connection of the indirect electrode to the direct electrode or the counter electrode. The switch connects and applies a voltage across the indirect electrode and the power source, and breaks the connection between the indirect
(Continued)

electrode and the power source and connects the indirect electrode to the direct electrode or the counter electrode.

8 Claims, 9 Drawing Sheets

(51) Int. Cl.

| | |
|---|---|
| ***C25D 17/00*** | (2006.01) |
| ***C25F 7/00*** | (2006.01) |
| ***C25D 21/12*** | (2006.01) |

ELECTRIC FIELD TREATMENT METHOD AND ELECTRIC FIELD TREATMENT DEVICE

CROSS-REFERENCE TO RELATED APPLICATIONS

This application is a 35 U.S.C. 371 National Phase Entry Application from PCT/JP2014/082969, filed Dec. 12, 2014, which claims priority under 35 USC 119 from Japanese Patent Application No. 2014-001466, filed Jan. 8, 2014 with the Japan Patent Office, the disclosures of which are incorporated herein in their entirety by reference.

TECHNICAL FIELD

The present invention relates to an electrolytic treatment method of performing a prescribed treatment using treatment target ions which are contained in a treatment liquid, and an electrolytic treatment device for performing the electric field treatment method.

BACKGROUND

An electrolytic process (electrolytic treatment) is a technique that is used for various treatments, such as, for example, a plating treatment or an etching treatment.

Such a plating treatment is performed by, for example, a plating device described in Patent Document 1. The plating device has a plating bath that stores a plating liquid, and the interior of the plating bath is divided into compartments by a regulation plate. An anode is disposed in one compartment, and a treatment target object (substrate) is immersed in another compartment, so that potential distribution between the anode and the treatment target object is regulated by the regulation plate. After the treatment target object is immersed into the plating liquid in the plating bath, a voltage is applied between the anode and the treatment target object in a state where the anode is set as a positive pole and the treatment target object is set as a negative pole, so that a current flows between the anode and the treatment target object. By this current, metallic ions contained in the plating liquid are migrated towards the treatment target object. Further, the metallic ions are precipitated as a plating metal on a treatment target object side. Thus, the plating treatment is performed.

For example, the plating device described in Patent Document 2 stirs and circulates a plating liquid in a plating bath when performing a plating treatment on a treatment target object.

PRIOR ART DOCUMENT

Patent Document

Patent Document 1: Japanese Patent Laid-Open Publication No. 2012-132058

Patent Document 2: Japanese Patent Laid-Open Publication No. 2006-348356

DISCLOSURE OF THE INVENTION

Problems to be Solved

In order to improve a plating rate in a plating treatment, it is considered that an electric field is increased in the plating treatment described in Patent Document 1, or a plating liquid is stirred and circulated as described in Patent Document 2, for example. However, when the electric field is increased as in the former, the electrolysis of water may be accompanied. In this case, hydrogen bubbles generated by the electrolysis of water generate voids in the plating metal that is precipitated on the treatment target object. Further, when the plating liquid is stirred as in the latter, a large-scale stirring mechanism is required. However, in some cases, it is impossible to install such a stirring mechanism in terms of the configuration of a device.

For example, in the plating treatment described in Patent Document 1, the current flows between the anode and the treatment target object even when sufficient metallic ions are not accumulated on a side of the treatment target object. Thus, the efficiency of the plating treatment is poor.

When the plating treatment is performed in the state where sufficient metallic ions are not accumulated as described above, that is, when the metallic ions reaching the treatment target object are subsequently precipitated, the plating metal is non-uniformly deposited on the treatment target object, and thereby the uniform plating treatment is not realized.

The present invention has been made in consideration of such problems, and an object of the present invention is to efficiently and appropriately perform a prescribed treatment for a treatment target object, using treatment target ions contained in a treatment liquid.

Means to Solve the Problems

In order to accomplish the above object, the present invention provides an electrolytic treatment method performing a prescribed treatment using treatment target ions contained in a treatment liquid. The method includes: an arranging step of arranging a direct electrode and a counter electrode with the treatment liquid being interposed therebetween, arranging an indirect electrode configured to form an electric field in the treatment liquid, and arranging a switch configured to perform a switching operation between connection of a power source with the indirect electrode and connection of the direct electrode or the counter electrode with the indirect electrode, a treatment target ion migrating step of migrating the treatment target ions contained in the treatment liquid to the counter electrode, by connecting the indirect electrode with the power source and then applying a voltage using the switch; and a treatment target ion treatment step of oxidizing or reducing the treatment target ions migrated to the counter electrode, by disconnecting the indirect electrode from the power source and connecting the indirect electrode to the direct electrode or the counter electrode using the switch.

According to the present invention, when the indirect electrode is connected to the power source by the switch and the voltage is applied to the indirect electrode to thereby generate the electric field (electrostatic field), electric charges are accumulated on the indirect electrode and treatment target ions are migrated to the counter electrode. Subsequently, when the switch performs a switching operation to connect the indirect electrode to the direct electrode or the counter electrode, the electric charges accumulated on the indirect electrode are moved to the direct electrode or the counter electrode, and the electric charges of the treatment target ions migrated to the counter electrode are exchanged, so that the treatment target ions are oxidized or reduced.

In this way, according to the present invention, when the accumulation (hereinafter sometimes referred to as "charging") of the electric charges on the indirect electrode and the movement (hereinafter sometimes referred to as "discharging") of the electric charges from the indirect electrode are switched using the switch, the migration of the treatment target ions and the oxidation or reduction (hereinafter sometimes referred to as "redox") of the treatment target ions are individually performed. Then, the exchange of the electric charges of the treatment target ions is not performed when the treatment target ions are migrated during the charging. Further, only the electric charges of the treatment target ions corresponding to the electric charges accumulated on the indirect electrode are exchanged when the treatment target ions are oxidized and reduced during the discharging. Therefore, since only the electric charges of the treatment target ions reaching the counter electrode are exchanged, it is possible to reliably suppress the water electrolysis occurring in the related art. Further, when the voltage is applied to the indirect electrode, the electric field may be increased and the treatment target ions may be rapidly migrated, so that the rate of the electrolytic treatment may be improved.

Since the redox of the treatment target ions may be performed in the state where the sufficient treatment target ions are accumulated on the counter electrode, it is unnecessary to flow a large quantity of current between the anode and the treatment target object as in the related art, thus allowing the treatment target ions to be efficiently oxidized and reduced.

Since the treatment target ions are substantially uniformly arranged on the surface of the counter electrode and then the exchange of electric charges, that is, since the electrolytic treatment is performed, a treated state (profile) in the electric field treatment, for example, the layer thickness in the plating treatment may be substantially uniformly formed.

According to another aspect, the present invention provides electrolytic treatment device that performs a prescribed treatment using treatment target ions contained in a treatment liquid. The device includes: a direct electrode and a counter electrode arranged such that the treatment liquid is interposed therebetween; an indirect electrode configured to form an electric field in the treatment liquid; and a switch configured to perform a switching operation between connection of a power source with the indirect electrode and connection of the direct electrode or the counter electrode with the indirect electrode. The switch connects the indirect electrode with the power source and applies a voltage, and the switch disconnects the indirect electrode from the power source, and connects the indirect electrode with the direct electrode or the counter electrode.

Effect of the Invention

According to the present invention, a prescribed treatment for a treatment target object may be efficiently and appropriately performed using treatment target ions contained in a treatment liquid.

DETAILED DESCRIPTION TO EXECUTE THE INVENTION

Figure 1:
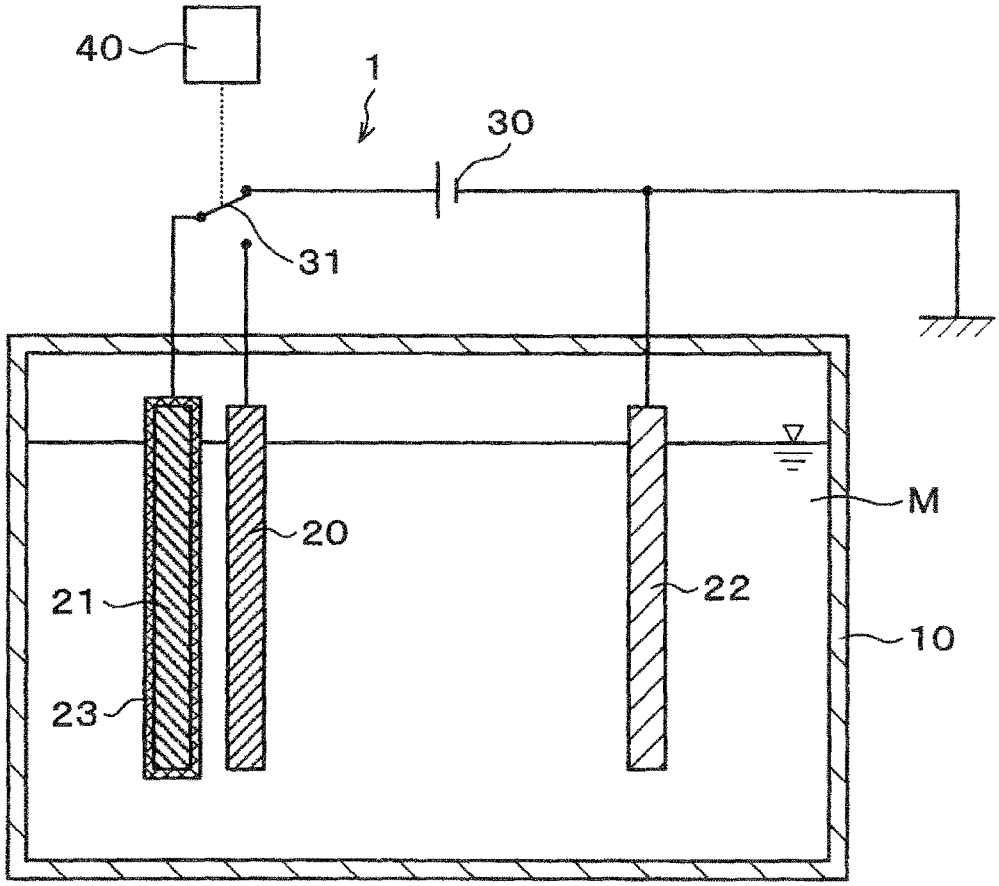
FIG. 1 is a longitudinal sectional view illustrating a schematic configuration of a plating treatment device according to an exemplary embodiment.

Hereinafter, exemplary embodiments of the present invention will be described. In these exemplary embodiments, descriptions will be made on a case in which a plating treatment is performed as an electrolytic treatment according to the present invention. FIG. 1 is a longitudinal sectional view illustrating a schematic configuration of a plating treatment device 1 as an electrolytic treatment device according to an exemplary embodiment. In the drawings used in the following description, dimensions of respective components do not necessarily correspond to actual dimensions so as to aid in easily understanding the present invention.

The plating treatment device 1 has a plating bath 10 that stores a plating liquid M as a treatment liquid therein. As the plating liquid M, for example a mixed solution obtained by dissolving copper sulfate and sulfuric acid is used. This plating liquid M contains copper ions as treatment target ions.

A direct electrode 20, an indirect electrode 21, and a counter electrode 22 are disposed in the plating bath 10 to be immersed in the plating liquid M. An insulating material 23 is provided on the indirect electrode 21 to cover the indirect electrode 21.

The direct electrode 20 is provided around the indirect electrode 21. The direct electrode 20 and the indirect electrode 21 have the same shape and are arranged to be spaced apart from and face each other.

The counter electrode 22 is arranged to face the direct electrode 20 and the indirect electrode 21 with the plating liquid M being interposed therebetween. In this exemplary embodiment, the counter electrode 22 is a treatment target object that is subjected to the plating treatment.

A DC power source 30 is connected to the indirect electrode 21 and the counter electrode 22. The indirect electrode 21 is connected to a positive pole side of the DC power source 30. The counter electrode 22 is connected to a negative pole side of the DC power source 30.

The indirect electrode 21 is provided with a switch 31. The switch 31 performs switching between a connection of the indirect electrode 21 and the DC power source 30 and a connection of the indirect electrode 21 and the direct electrode 20. The switching operation of the switch 31 is controlled by the controller 40.

Next, the plating treatment using the plating treatment device 1 configured as such will be described.

Figure 2:
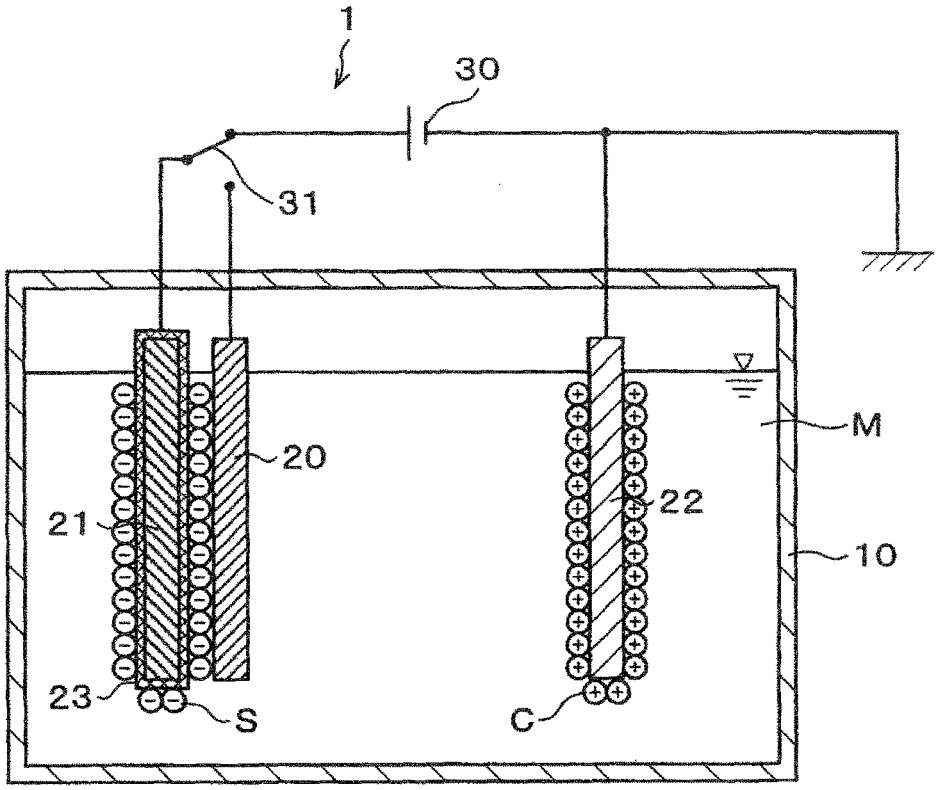
FIG. 2 is an explanatory view illustrating a state in which an indirect electrode is connected to a DC power source.
Figure 3:
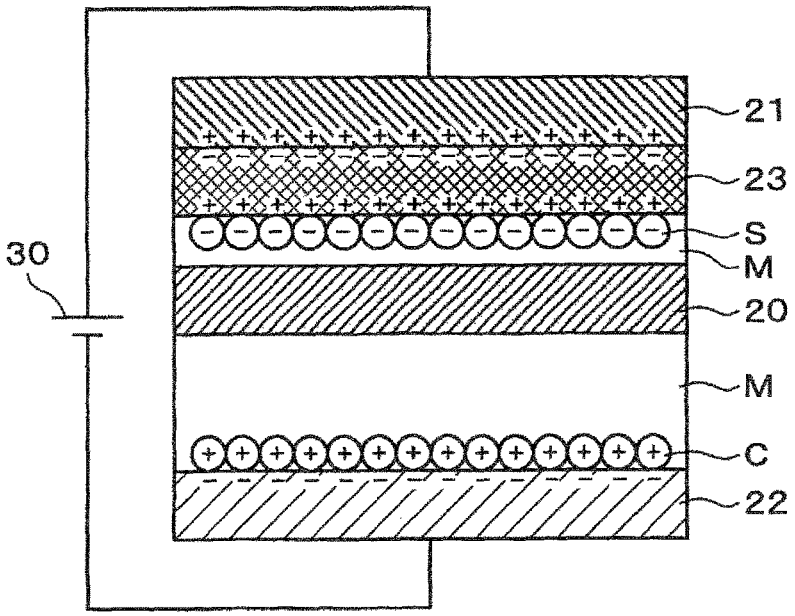
FIG. 3 is an explanatory view schematically illustrating the arrangement of electric charges and ions during a charging operation.

As illustrated in FIG. 2, the indirect electrode 21 and the DC power source 30 (counter electrode 22) are connected to each other by the switch 31. In the state where the indirect electrode 21 is set as the positive pole and the counter electrode 22 is set as the negative pole, a DC voltage is applied to form an electric field (electrostatic field). Then, as illustrated in FIG. 3, positive electric charges are accumulated on the indirect electrode 21, so that sulfuric acid ions S that are negatively charged particles are collected on the indirect electrode 21. Meanwhile, the negative electric charges are accumulated on the counter electrode 22, so that copper ions C that are positively charged particles are migrated into the counter electrode 22. In the following description, a state in which the indirect electrode 21 and the DC power source 30 are connected to each other by the switch 31 and electric charges are accumulated on the indirect electrode 21 may be referred to as "charging."

In order to avoid the direct electrode 20 from becoming the negative pole, the direct electrode 20 is not connected to a ground, but is in an electrically floating state. In such a situation, the exchange of electric charges is not performed on all the surfaces of the direct electrode 20, the indirect electrode 21, and the counter electrode 22, and thus, charged particles attracted by the electrostatic field are arranged on the surfaces of the electrodes.

The connection between the indirect electrode 21 and the DC power source 30 is performed by the switch 31 until sufficient electric charges are accumulated on the indirect electrode 21 and the counter electrode 22, that is, until the indirect electrode 21 and the counter electrode 22 are fully charged. Then, the copper ions C are uniformly arranged on the surface of the counter electrode 22. Since the exchange of the electric charges of the copper ions C is not performed on the surface of the counter electrode 22 and the electrolysis of water is suppressed, it is possible to increase the electric field when a voltage is applied between the indirect electrode 21 and the counter electrode 22. This high electric field allows the copper ions C to be rapidly moved. Further, the copper ions C arranged on the surface of the counter electrode 22 are also arbitrarily controlled by arbitrarily controlling the electric field.

Figure 4:
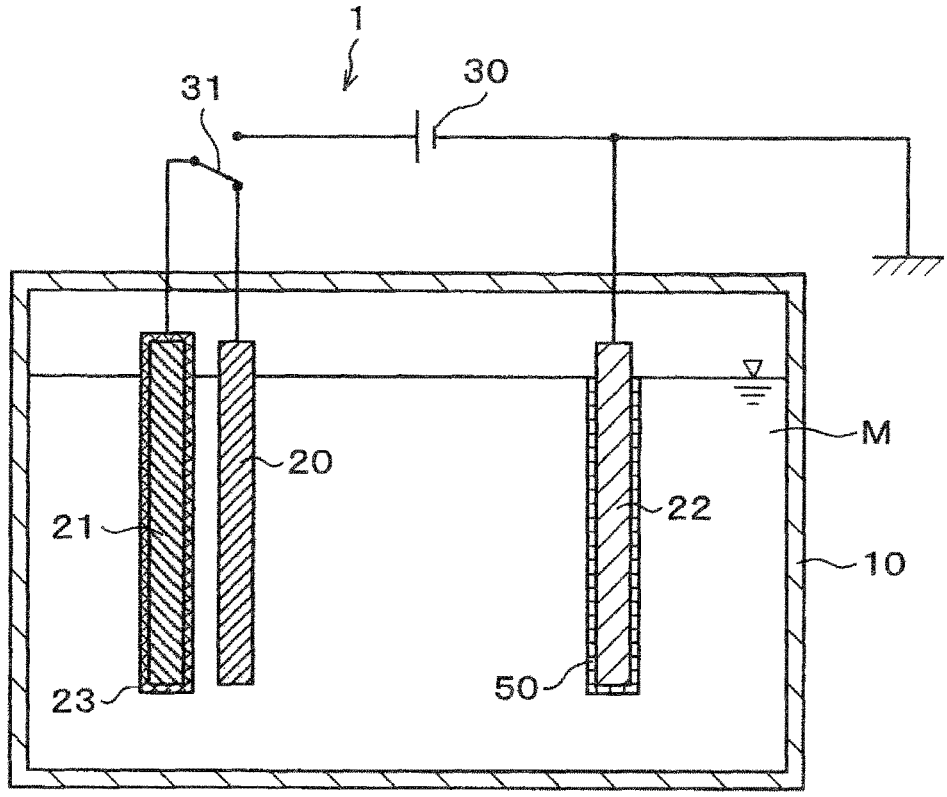
FIG. 4 is an explanatory view illustrating a state in which the indirect electrode is connected to a direct electrode.
Figure 5:
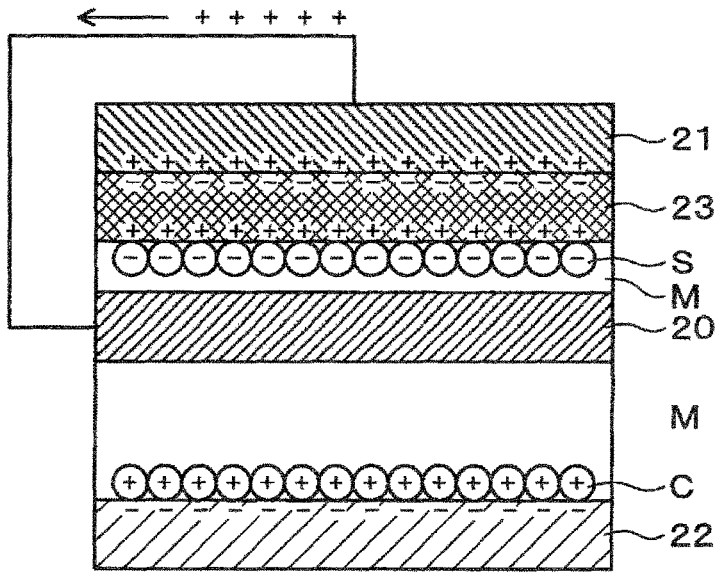
FIG. 5 is an explanatory view schematically illustrating the arrangement of electric charges and ions during a discharging operation.

Thereafter, as illustrated in FIG. 4, the switch 31 performs the switching operation to disconnect the indirect electrode 21 from the DC power source 30 and to connect the indirect electrode 21 to the direct electrode 20. Then, as illustrated in FIG. 5, positive electric charges accumulated on the indirect electrode 21 are moved to the direct electrode 20, and electric charges of the sulfuric acid ions S collected on the indirect electrode 21 are exchanged, so that the sulfuric acid ions S are oxidized. Thus, the electric charges of the copper ions C arranged on the surface of the counter electrode 22 are exchanged, so that the copper ions C are reduced. Further, as illustrated in FIG. 4, copper plating 50 is deposited on the surface of the counter electrode 22. In the following description, a state in which the indirect electrode 21 and the direct electrode 20 are connected to each other by the switch 31 and electric charges are moved from the indirect electrode 21 may be referred to as "discharging."

Since sufficient copper ions C are accumulated on the surface of the counter electrode 22 and are reduced in a uniformly arranged state, the copper plating 50 may be uniformly deposited on the surface of the counter electrode 22. Consequently, the density of crystals on the copper plating 50 is increased to enable the copper plating 50 of good quality to be formed. A conventional plating process is problematic in that a plating layer becomes non-uniform due to the intensity distribution of the electric field on the surface of the treatment target object. However, in the exemplary embodiment, since the reduction is performed in the state where the copper ions C are uniformly arranged on the surface of the counter electrode 22, the plating layer of high quality may be uniformly formed.

Figure 6:
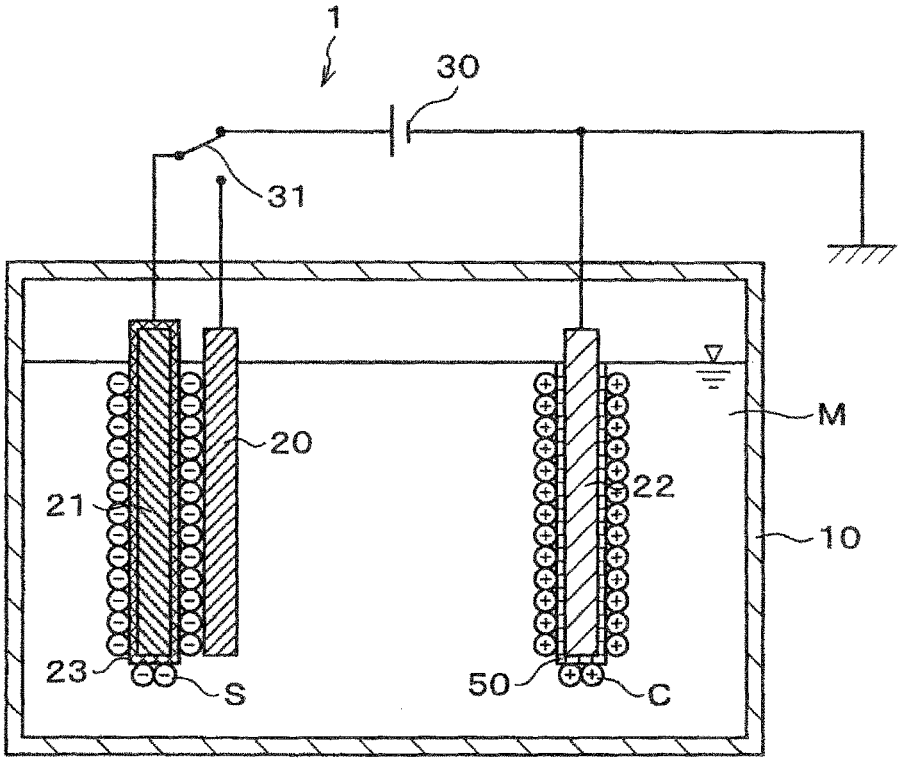
FIG. 6 is an explanatory view illustrating a state in which the indirect electrode is connected to the DC power source again.

Thereafter, as illustrated in FIG. 6, the switch 31 performs the switching operation to connect the indirect electrode 21 to the DC power source 30, and to migrate the copper ions C towards the counter electrode 22 and thereby accumulate them. When the copper ions C are uniformly arranged on the surface of the counter electrode 22, the switch 31 performs the switching operation to connect the indirect electrode 21 to the direct electrode 20, and to reduce the copper ions C.

Figure 7:
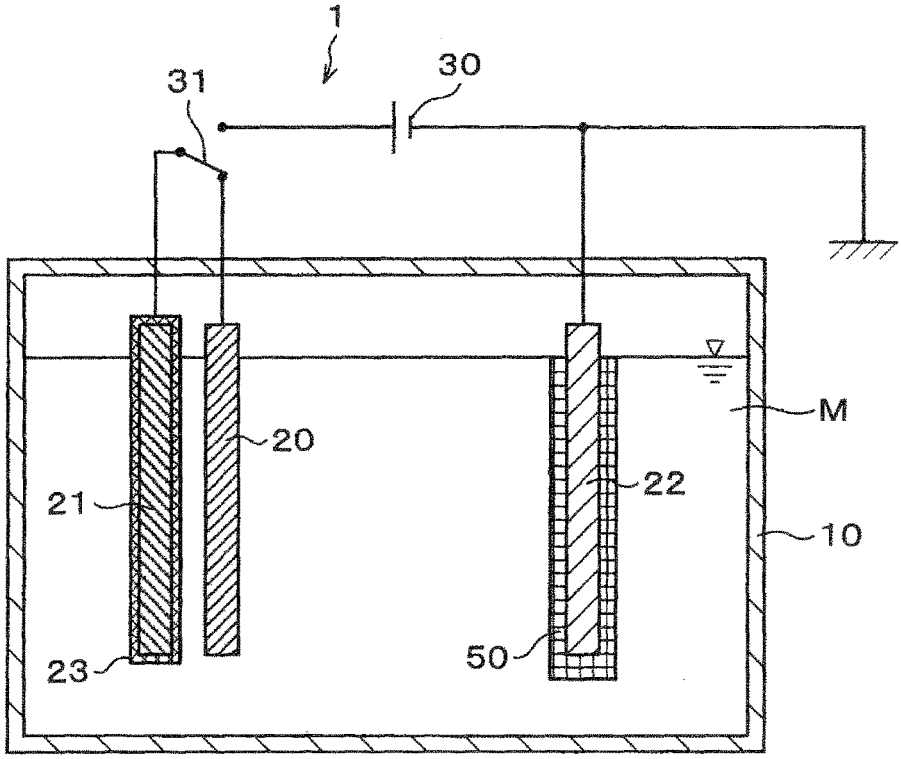
FIG. 7 is an explanatory view illustrating a state in which predetermined copper plating is formed on a counter electrode.

When the migration and accumulation of the copper ions C during the charging and the reduction of the copper ions C during discharging are repeatedly performed as described above, the copper plating 50 grows to a predetermined layer thickness as illustrated in FIG. 7. In this way, a series of plating processes is completed in the plating treatment device 1.

According to the above-described exemplary embodiment, the migration of the copper ions C and the reduction of the copper ions C are individually performed by switching the charging and the discharging by the switch 31. Then, when the copper ions C are migrated during the charging, the exchange of the electric charges of the copper ions C is not performed. Further, when the copper ions C are reduced during the discharging, only the electric charges of the copper ions C corresponding to the electric charges accumulated in the indirect electrode 21 are exchanged. Therefore, since only the electric charges of the copper ions C reaching the counter electrode 22 are exchanged, it is possible to reliably suppress the electrolysis of water as in the related art, and to suppress the generation of voids in the copper plating 50. Further, it is possible to increase the electric field when the voltage is applied to the indirect electrode 21, and to rapidly migrate the copper ions C such that an electrolytic treatment rate can be improved. Moreover, in order to improve a plating treatment rate, the above-described exemplary embodiment does not require a large-scale mechanism for stirring and circulating the plating liquid unlike the related art, thus simplifying the configuration of the device.

Since sufficient electric charges are accumulated on the indirect electrode 21 and the switch 31 performs the switching operation between the charging and the discharging in the state in which the copper ions C are uniformly arranged on the surface of the counter electrode 22, the copper ions C may be reduced with the sufficient copper ions C being accumulated on the counter electrode 22. Hence, it is unnecessary to flow a large quantity of current between the anode and the treatment target object as in the related art, thus enabling the copper ions C to be efficiently reduced.

Since the copper ions C uniformly arranged on the surface of the counter electrode 22 may be uniformly reduced, the plating treatment may be uniformly performed and thereby the layer of the copper plating 50 may be uniformly formed. Moreover, since the copper ions C are uniformly arranged, crystals in the copper plating 50 may be densely arranged. Therefore, it is possible to improve the quality of the treatment target object obtained after the plating treatment.

A method is also considered in which the copper ions C on the surface of the counter electrode 22 are reduced by applying the electric field between the direct electrode 20 and the counter electrode 22 at a predetermined timing in the state where the indirect electrode 21 and the DC power source 30 are connected to each other and the charging is continued, without performing the switching operation between the charging and the discharging by the switch 31 as in the exemplary embodiment. However, a charging time when the electric charges are accumulated on the indirect electrode 21 is determined, depending on variable factors such as, for example, the surface areas of the indirect electrode 21 and the counter electrode 22, the migration distances of the sulfuric acid ions S and the copper ions C, and the concentration of the sulfuric acid ions S and the copper ions C in the plating liquid M. That is, as the charging time is continuously changed, it is difficult to control the charging time. In this respect, according to the exemplary embodiment, since only the electric charges of the copper ions C corresponding to the electric charges accumulated on the indirect electrode 21 are exchanged, it is possible to efficiently oxidize the copper ions C.

In the plating treatment device 1 of the above-described exemplary embodiment, the arrangement or the structure of the direct electrode 20, the indirect electrode 21 and the counter electrode 22 may be arbitrarily set. All the exemplary embodiments illustrated in FIGS. 8 to 14 may achieve the same effect as the exemplary embodiment described above.

Figure 8:
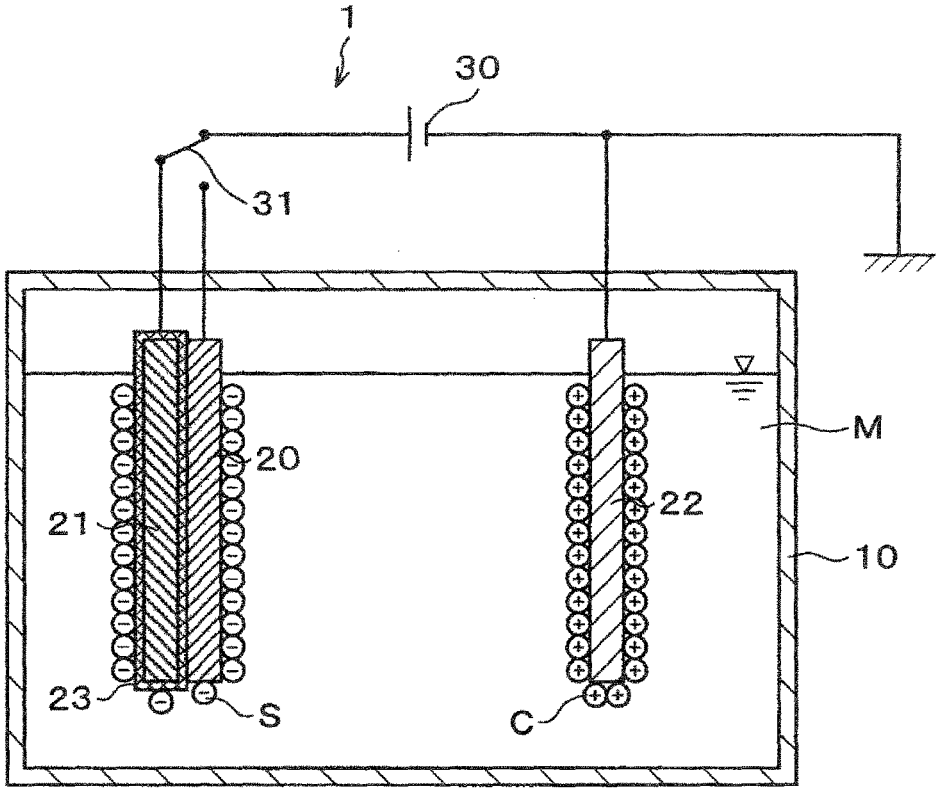
FIG. 8 is a longitudinal sectional view illustrating a schematic configuration of a plating treatment device according to another exemplary embodiment.

For example, as illustrated in FIG. 8, the direct electrode 20 and the indirect electrode 21 may be arranged to be closely attached to each other via the insulating material 23. The close attachment mentioned herein means that, for example, a surface of the direct electrode 20 and an inner surface of the indirect electrode 21 come into contact with each other via the insulating material 23, and thereby the direct electrode 20 and the indirect electrode 21 have an integrated structure.

Figure 9:
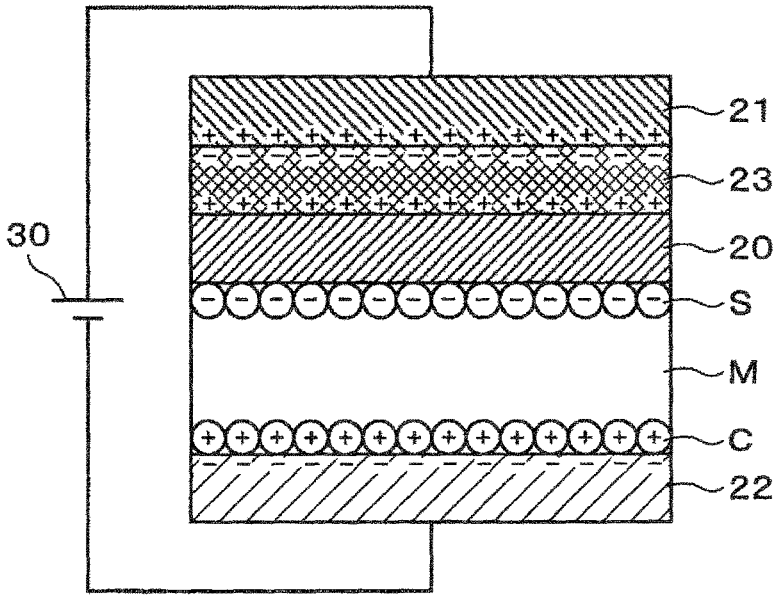
FIG. 9 is an explanatory view schematically illustrating the arrangement of electric charges and ions during a charging operation according to another exemplary embodiment.
Figure 10:
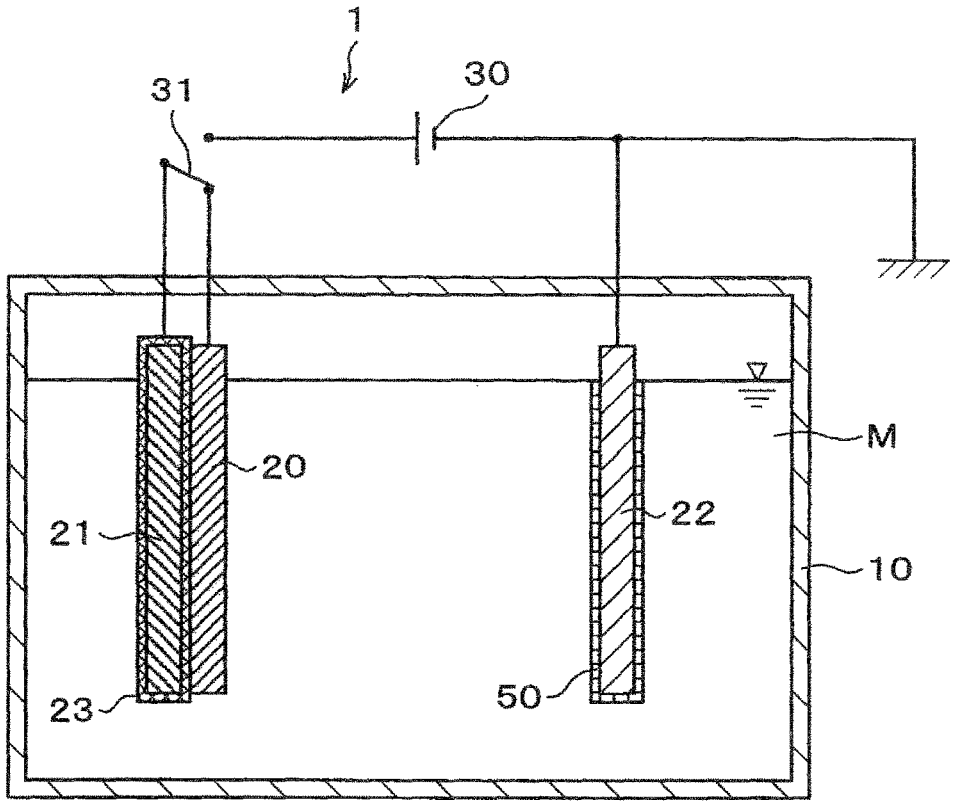
FIG. 10 is an explanatory view illustrating a state in which an indirect electrode is connected to a direct electrode according to another exemplary embodiment.
Figure 11:
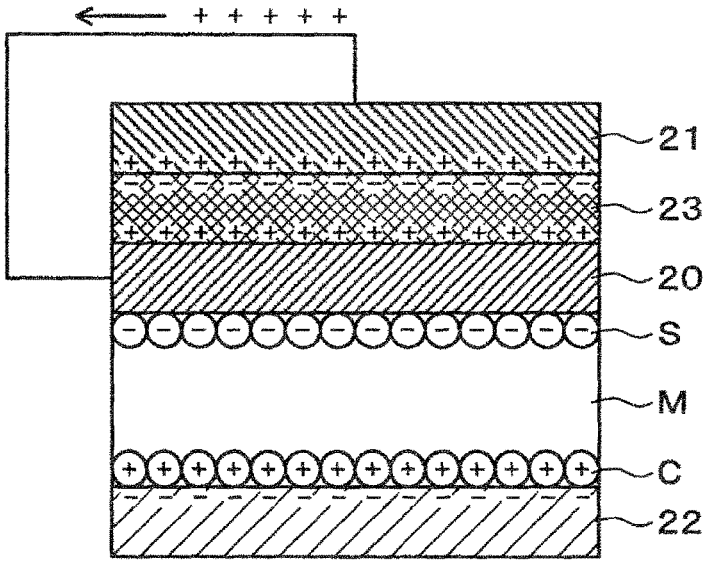
FIG. 11 is an explanatory view schematically illustrating the arrangement of electric charges and ions during a discharging operation according to another exemplary embodiment.

In this case, when the indirect electrode 21 is connected to the DC power source 30 by the switch 31, as illustrated in FIG. 9, the positive electric charges are accumulated on the indirect electrode 21, and thereby the sulfuric acid ions S are collected on the direct electrode 20 (and the indirect electrode 21). Subsequently, when the switch 31 performs the switching operation to connect the indirect electrode 21 to the direct electrode 20 as illustrated in FIG. 10, the positive electric charges accumulated on the indirect electrode 21 are moved to the direct electrode 20, and the electric charges of the sulfuric acid ions S collected on the direct electrode 20 (and the indirect electrode 21) are exchanged, as illustrated in FIG. 11, so that the sulfuric acid ions S are oxidized. Since the sulfuric acid ions S are collected on the direct electrode 20, the oxidation reaction of the sulfuric acid ions S is facilitated on the direct electrode 20. Therefore, the copper ions C may be more efficiently reduced.

Figure 12:
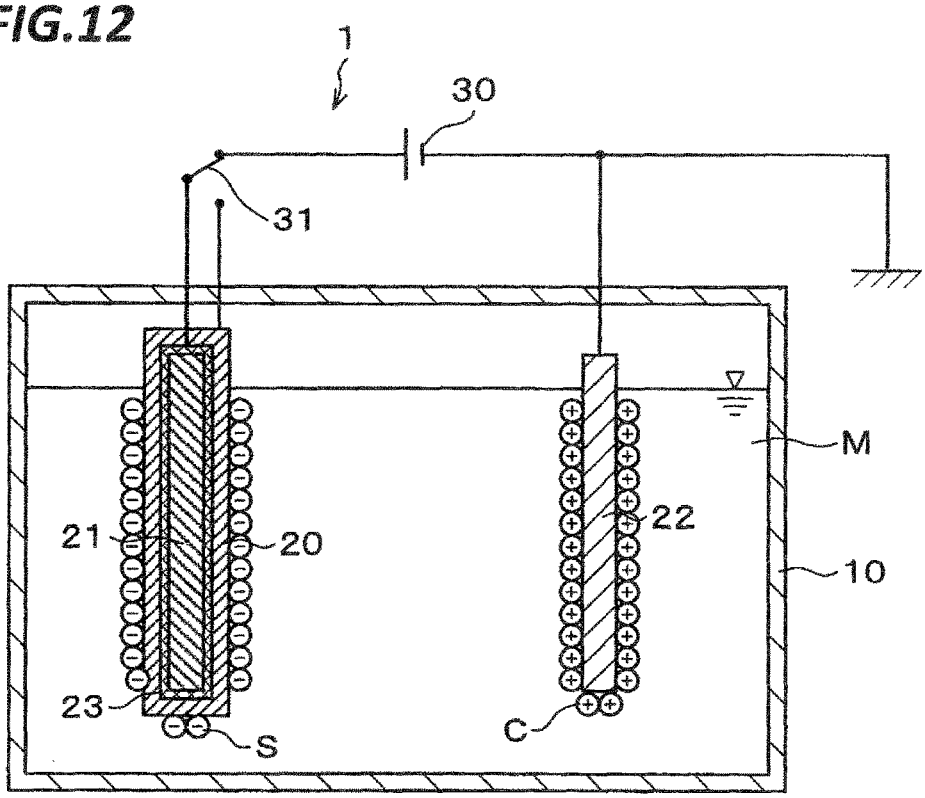
FIG. 12 is a longitudinal sectional view illustrating a schematic configuration of a plating treatment device according to another exemplary embodiment.

For example, as illustrated in FIG. 12, the indirect electrode 21 and the insulating material 23 may be arranged to be completely covered by the direct electrode 20. In this case, since the indirect electrode 21 does not come into contact with the plating liquid M, the sulfuric acid ions S may be more efficiently collected on the surface of the direct electrode 20. Further, it is possible to reliably cause the electric charges accumulated on the indirect electrode 21, namely, the sulfuric acid ions S collected on the direct electrode 20 and the copper ions C migrated into and arranged on the counter electrode 22 to become electrically equivalent. Therefore, it is possible to improve the reproducibility of the plating treatment, thus enabling the layer thickness of the copper plating 50 to be more easily controlled. That is, the copper plating 50 may be deposited with a uniform layer thickness by reducing the copper ions C once. Therefore, the layer thickness of the copper plating 50 may be appropriately controlled by repeating the reduction of the copper ions C several times.

Figure 13:
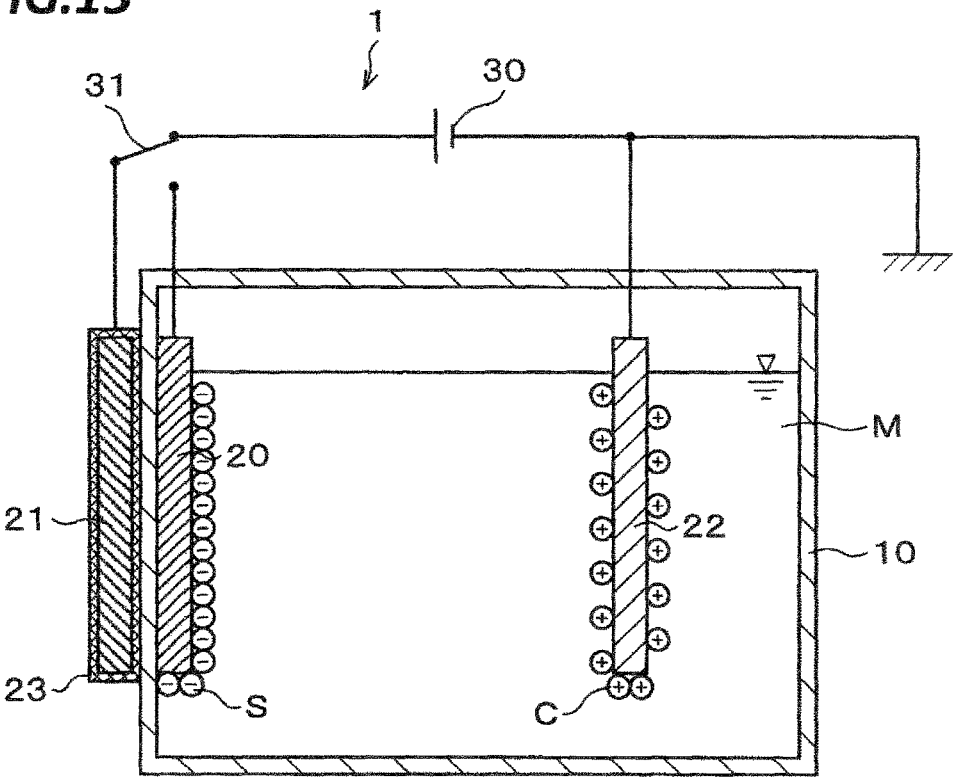
FIG. 13 is a longitudinal sectional view illustrating a schematic configuration of a plating treatment device according to another exemplary embodiment.

As illustrated in FIG. 13, the indirect electrode 21 may be provided on an exterior of the plating bath 10. The indirect electrode 21 is provided on an outer surface of the plating bath 10, and the direct electrode 20 is provided on an inner surface of the plating bath 10. The plating bath 10 is configured to be in the electrically floating state. Even in this case, since the indirect electrode 21 does not come into contact with the plating liquid M, this may obtain the same effect as the exemplary embodiment illustrated in FIG. 12. For example, when the plating bath 10 is an insulator, the insulating material 23 provided around the indirect electrode 21 may be omitted. Further, the electrode structure of the direct electrode 20, the indirect electrode 21, and the counter electrode 22 may take various shapes. When the indirect electrode 21 is provided on the exterior of the plating bath 10 as illustrated in FIG. 13, the indirect electrode 21 may be freely designed depending on the shape of the plating bath 10.

Figure 14:
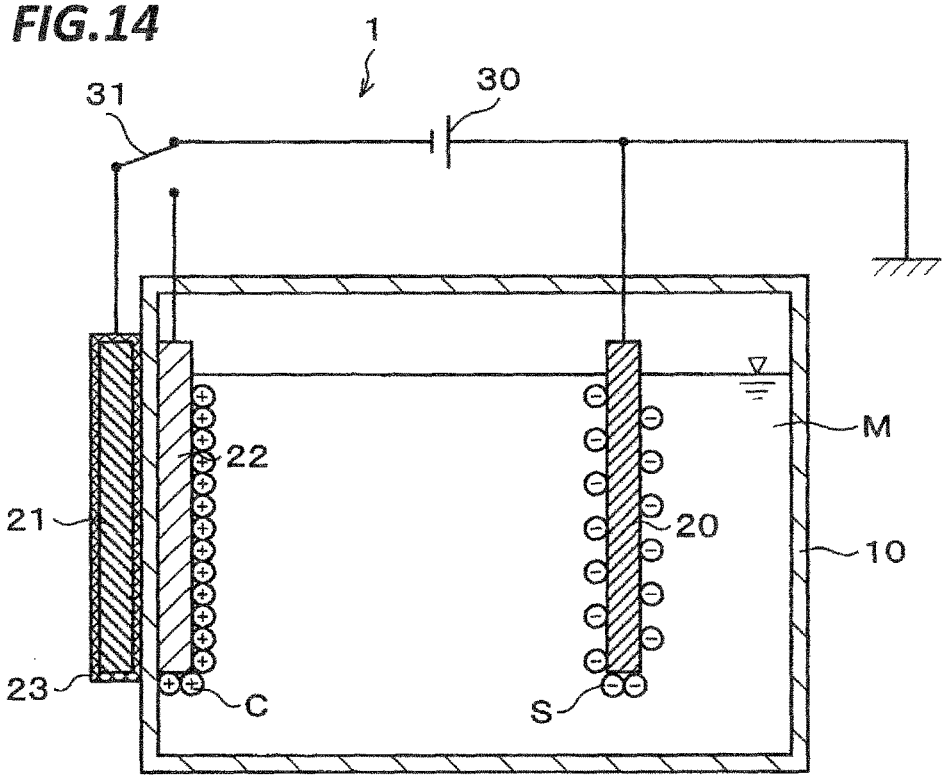
FIG. 14 is a longitudinal sectional view illustrating a schematic configuration of a plating treatment device according to another exemplary embodiment.

For example, as illustrated in FIG. 14, the counter electrode 22 may be provided at the indirect electrode 21 side, and the direct electrode 20 may be disposed to face the counter electrode 22 and the indirect electrode 21 with the plating liquid M interposed therebetween. In an illustrated example, similarly to the exemplary embodiment of FIG. 13, the indirect electrode 21 is provided on the outer surface of the plating bath 10, and the counter electrode 22 is provided on the inner surface of the plating bath 10. The indirect electrode 21 is connected to the negative pole side of the DC power source 30, and the direct electrode 20 is connected to the positive pole side of the DC power source 30. Further, the switch 31 is provided to perform the switching operation between the connection of the indirect electrode 21 and the DC power source 30, and the connection of the indirect electrode 21 and the counter electrode 22.

In this case, the indirect electrode 21 and the DC power source 30 are connected to each other by the switch 31, the indirect electrode 21 is set as the negative pole, the direct electrode 20 is set as the positive pole, and the DC voltage is applied. Then, the negative electric charges are accumulated on the indirect electrode 21, so that the copper ions C are collected on the side of the counter electrode 22. Meanwhile, the positive electric charges are accumulated on the direct electrode 20, so that the sulfuric acid ions S are collected on the side of the direct electrode 20. Thereafter, if the switch 31 performs the switching operation to connect the indirect electrode 21 with the counter electrode 22, the negative electric charges accumulated on the indirect electrode 21 are moved to the counter electrode 22, the electric charges of the copper ions C arranged on the counter electrode 22 are exchanged and thereby the copper ions C are reduced. At this time, since the exchange of the electric charges of the copper ions C in the counter electrode 22 is directly performed by the movement of the electric charges from the indirect electrode 21, the copper ions C may be more efficiently reduced.

Although the above-described exemplary embodiment describes a case where the plating treatment is performed as the electrolytic treatment, the present invention is applicable to several electrolytic treatments such as, for example, an etching treatment. Hereinafter, a case where a wet etching treatment is performed as the electrolytic treatment will be described.

Figure 15:
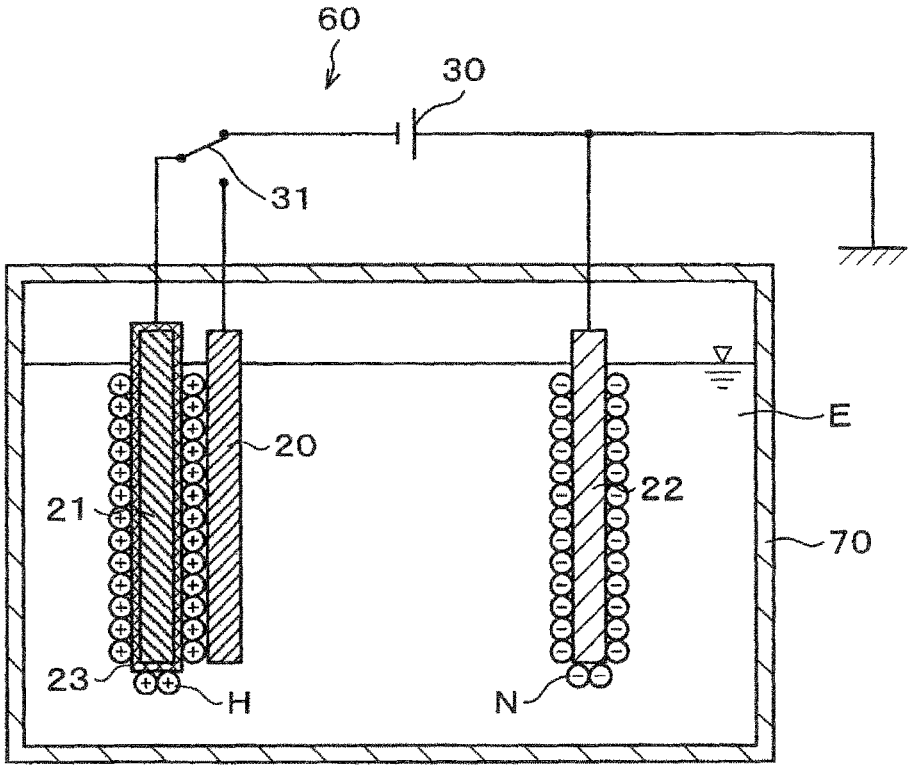
FIG. 15 is a longitudinal sectional view illustrating a schematic configuration of an etching treatment device according to another exemplary embodiment.

For example, as illustrated in FIG. 15, the etching treatment device 60 as the electrolytic treatment device has an etchant bath 70 that stores an etchant E as the treatment liquid therein. Examples of the etchant E may use a mixed solution (HF/IPA) of hydrofluoric acid and isopropyl alcohol or a mixed solution of hydrofluoric acid and ethanol.

The indirect electrode 21 is connected to the negative pole side of the DC power source 30, and the counter electrode 22 is connected to the positive pole side of the DC power source 30. Since the other configuration of the etching treatment device 60 remains the same as the configuration of the plating treatment device 1 illustrated in FIG. 1, a detailed description thereof will be omitted herein.

In this case, the indirect electrode 21 and the DC power source 30 are connected to each other by the switch 31, the indirect electrode 21 is set as the negative pole, the counter electrode 22 is set as the positive pole, and then the DC voltage is applied. Then, the negative electric charges are accumulated on the indirect electrode 21, so that positively charged particles H are collected on the side of the indirect electrode 21. Meanwhile, the positive electric charges are accumulated on the counter electrode 22, so that the ions N to be treated that are anions in the etchant E are migrated to the counter electrode 22. Thereafter, if the switch 31 performs the switching operation to connect the indirect electrode 21 with the direct electrode 20, the negative electric charges accumulated on the indirect electrode 21 are moved to the direct electrode 20, and the electric charges of the charged particles H collected on the side of the indirect electrode 21 are exchanged, so that the charged particles H are reduced. Thus, the electric charges of the treatment target ions N arranged on the surface of the counter electrode 22 are exchanged, so that the treatment target ions N are oxidized. Further, the surface of the counter electrode 22 is etched.

This exemplary embodiment may obtain the same effect as the above-mentioned exemplary embodiments, although the treatment target ions are oxidized in this exemplary embodiment and are reduced in the above-mentioned exemplary embodiments.

Likewise in the etching treatment device 60 of the above-described exemplary embodiment, the arrangement or the electrode structure of the direct electrode 20, the indirect electrode 21 and the counter electrode 22 may be arbitrarily set. Although the etching treatment device 60 illustrated in FIG. 15 has the same electrode arrangement or structure as the plating treatment device 1 illustrated in FIG. 1, the etching treatment device may have the same electrode arrangement or structure as the plating treatment device 1 illustrated in FIGS. 8 to 14.

Figure 16:
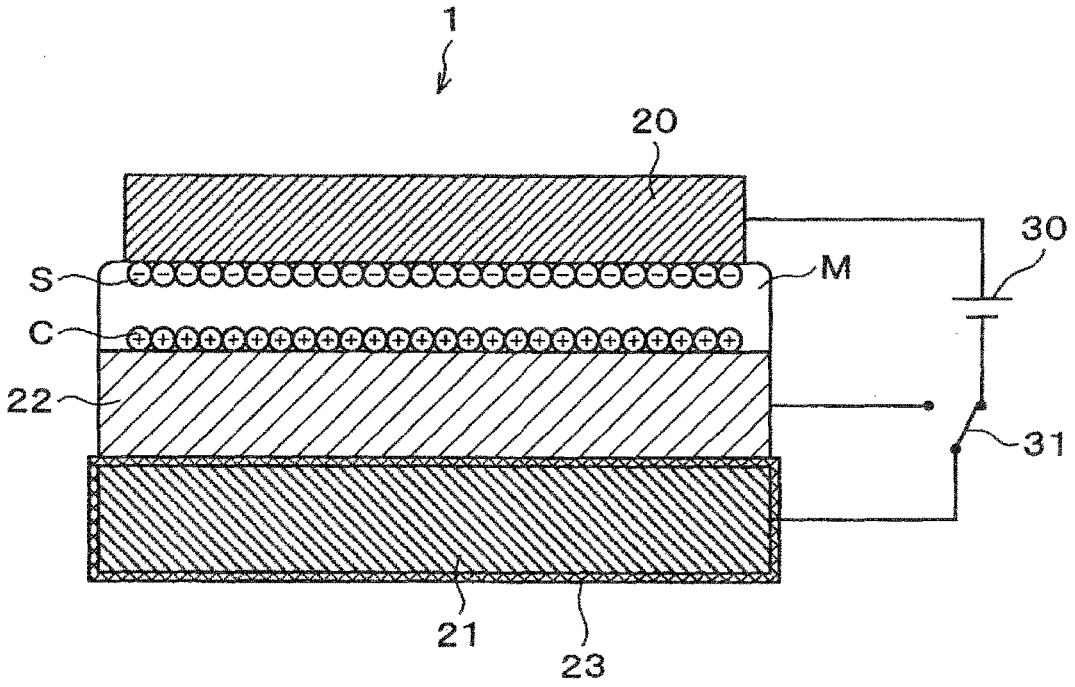
FIG. 16 is a longitudinal sectional view illustrating a schematic configuration of a plating treatment device according to another exemplary embodiment.

Although the plating treatment device 1 of the above embodiment performs the plating treatment on the counter electrode 22 using the plating liquid M stored in the plating bath 10, the plating treatment may be performed by supplying the plating liquid M to the counter electrode 22, as illustrated in FIG. 16.

For example, the plating liquid M is supplied to the upper surface of a substantially flat plate-shaped counter electrode 22. The plating liquid M stays on the counter electrode 22 by surface tension, for example. The direct electrode 20 is also disposed on this plating liquid M. The indirect electrode 21 is disposed on a lower surface of the counter electrode 22. The indirect electrode 21 is connected to the negative pole side of the DC power source 30, while the direct electrode 20 is connected to the positive pole side of the DC power source 30. The switch 31 is provided to perform the switching operation between the connection of the indirect electrode 21 and the DC power source 30, and the connection of the indirect electrode 21 and the counter electrode 22.

In this case, when the indirect electrode 21 and the DC power source 30 are connected to each other by the switch 31, the negative electric charges are accumulated on the indirect electrode 21, so that the copper ions C are collected on the counter electrode 22. Meanwhile, the positive electric charges are accumulated on the direct electrode 20, so that the sulfuric acid ions S are collected on the side of the direct electrode 20. Thereafter, when the switch 31 performs the switching operation to connect the indirect electrode 21 with the counter electrode 22, the negative electric charges accumulated on the indirect electrode 21 are moved to the counter electrode 22, and the electric charges of the copper ions C arranged on the counter electrode 22 are exchanged, so that the copper ions C are reduced. Therefore, this may obtain the same effect as the above-described exemplary embodiments.

The plating treatment performed according to the exemplary embodiment of FIG. 16 may be a plating treatment in a manufacturing process of a semiconductor device. In this case, the counter electrode 22 may be a semiconductor substrate, and the indirect electrode 21 may be a support member of the semiconductor substrate. Examples of the support member may use a support substrate of the semiconductor substrate, or a substrate holding mechanism such as, for example, an electrostatic chuck for holding the semiconductor substrate.

Figure 17:
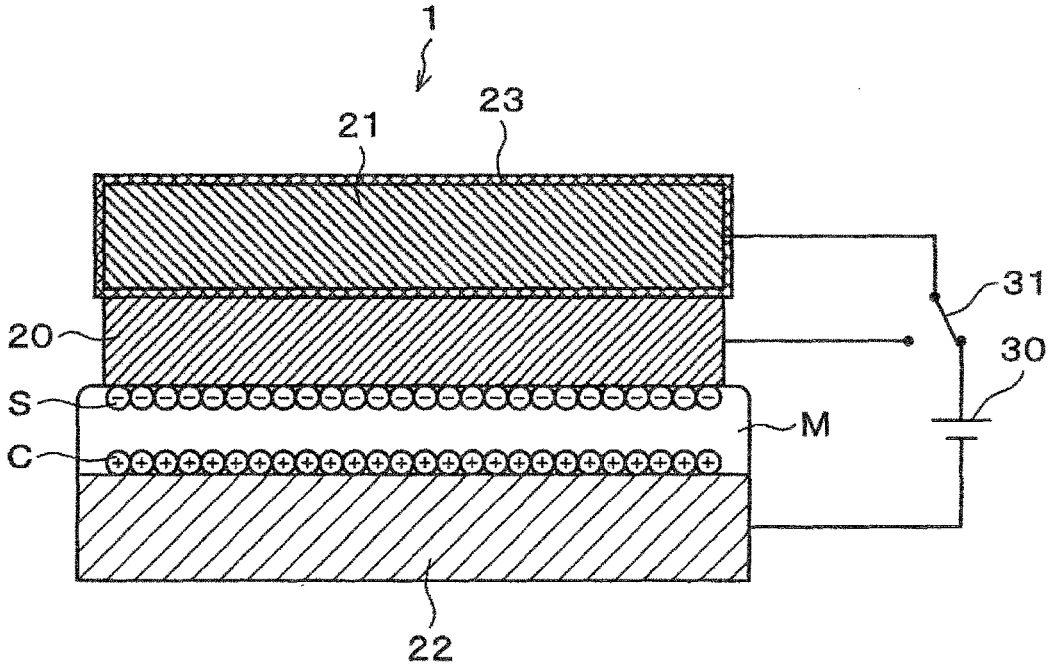
FIG. 17 is a longitudinal sectional view illustrating a schematic configuration of a plating treatment device according to another exemplary embodiment.

Although, in FIG. 16, the indirect electrode 21 is provided on the lower surface of the counter electrode 22, the indirect electrode may be provided on an upper surface of the direct electrode 20 as illustrated in FIG. 17. The indirect electrode 21 is connected to the positive pole side of the DC power source 30, and the counter electrode 22 is connected to the negative pole side of the DC power source 30. The switch 31 is provided to perform the switching operation between the connection of the indirect electrode 21 and the DC power source 30, and the connection of the indirect electrode 21 and the direct electrode 20.

In this case, when the indirect electrode 21 and the DC power source 30 are connected to each other by the switch 31, the positive electric charges are accumulated on the indirect electrode 21, and the sulfuric acid ions S are collected on the side of the direct electrode 20. Meanwhile, the negative electric charges are accumulated on the counter electrode 22, so that the copper ions C are collected on the side of the counter electrode 22. Thereafter, when the switch 31 performs the switching operation to connect the indirect electrode 21 with the direct electrode 20, the positive electric charges accumulated on the indirect electrode 21 are moved to the direct electrode 20, and the electric charges of the copper ions C arranged on the counter electrode 22 are exchanged, so that the copper ions C are reduced. Therefore, this may obtain the same effect as the above-described exemplary embodiments.

Further, the plating treatment performed according to the exemplary embodiment of FIG. 17 may also be a plating treatment in a manufacturing process of a semiconductor device, similarly to the case of FIG. 16. In this case, the direct electrode 20 may be a semiconductor substrate, and the indirect electrode 21 may be a support member of the semiconductor substrate. Examples of the support member may use a support substrate of the semiconductor substrate, or a substrate holding mechanism such as, for example, an electrostatic chuck for holding the semiconductor substrate.

Thus, even when the direct electrode 20, the indirect electrode 21 and the counter electrode 22 are arranged by stacking them, both the oxidation (e.g., etching treatment) and the reduction (e.g., plating treatment) of the treatment target ions may be performed. In order to perform the oxidation and the reduction, the positive pole and the negative pole of the DC power source 30 are arranged oppositely, and the positive pole and the negative pole are set oppositely, so that the electrolytic treatment is performed.

Although the exemplary embodiments of the present invention have been described with reference to the accompanying drawings, the present invention is not limited to the exemplary embodiments. It is apparent to those skilled in the art that many modifications or changes may be made without departing from the scope of the invention as disclosed in the accompanying claims. The present invention may adopt several aspects without being limited to the examples.

Description of Symbols

| | |
|---|---|
| 1: plating treatment device | 10: plating bath |
| 20: direct electrode | 21: indirect electrode |
| 22: counter electrode | 23: insulating material |
| 30: DC power source | 31: switch |
| 40: controller | 50: copper plating |
| 60: etching treatment device | 70: etchant bath |
| C: copper ions | E: etchant |
| H: charged particles | M: plating liquid |
| N: treatment target ions | S: sulfuric acid ions |

What is claimed is:

1. An electrolytic treatment method for performing a prescribed treatment using treatment target ions contained in a treatment liquid, the method comprising:

an arranging step of arranging a direct electrode and a counter electrode with the treatment liquid being interposed therebetween, arranging an indirect electrode configured to form an electric field in the treatment liquid, and arranging a switch configured to perform a switching operation between connection of a power source with the indirect electrode and connection of the direct electrode or the counter electrode with the indirect electrode;

a treatment target ion migrating step of migrating the treatment target ions contained in the treatment liquid to the counter electrode, by connecting the indirect electrode with the power source and then applying a voltage using the switch; and a treatment target ion treatment step of oxidizing or reducing the treatment target ions migrated to the counter electrode, by disconnecting the indirect electrode from the power source and connecting the indirect electrode to the direct electrode or the counter electrode using the switch.

2. The method of claim 1, wherein the treatment target ion migrating step is performed until the treatment target ions are uniformly arranged on a surface of the counter electrode.

3. The method of claim 1, wherein, in the arranging step, the indirect electrode is disposed so as not to come into contact with the treatment liquid.

4. The method of claim 1, wherein the direct electrode or the counter electrode connected to or disconnected from the indirect electrode by the switch is a semiconductor substrate, and the indirect electrode is a support member that supports the semiconductor substrate.

5. An electrolytic treatment device that performs a prescribed treatment using treatment target ions contained in a treatment liquid, the device comprising:

a direct electrode and a counter electrode arranged such that the treatment liquid is interposed therebetween;

an indirect electrode configured to form an electric field in the treatment liquid; and a switch configured to perform a switching operation between connection of a power source with the indirect electrode and connection of the direct electrode or the counter electrode with the indirect electrode, wherein the switch connects the indirect electrode with the power source and applies a voltage, and the switch disconnects the indirect electrode from the power source, and connects the indirect electrode with the direct electrode or the counter electrode.

6. The device of claim 5, wherein, when the treatment target ions are uniformly arranged on a surface of the counter electrode, the switch disconnects the indirect electrode from the power source, and connects the indirect electrode with the direct electrode or the counter electrode.

7. The device of claim 5, wherein the indirect electrode is disposed so as not to come into contact with the treatment liquid.

8. The device of claim 5, wherein the direct electrode or the counter electrode connected to or disconnected from the indirect electrode by the switch is a semiconductor substrate, and the indirect electrode is a support member that supports the semiconductor substrate.

* * * * *